US012006787B2

(12) United States Patent
Francis et al.

(10) Patent No.: US 12,006,787 B2
(45) Date of Patent: Jun. 11, 2024

(54) DELAYED OPENING FLUID COMMUNICATION VALVE

(71) Applicant: Summit Casing Services, LLC, Fort Worth, TX (US)

(72) Inventors: Colten T. Francis, Aledo, TX (US); Ian Beckett, Aledo, TX (US); Andrew M. Eldridge, Fort Worth, TX (US)

(73) Assignee: SUMMIT CASING SERVICES, LLC, Fort Worth, TX (US)

( * ) Notice: Subject to any disclaimer, the term of this patent is extended or adjusted under 35 U.S.C. 154(b) by 0 days.

(21) Appl. No.: 17/889,467

(22) Filed: Aug. 17, 2022

(65) Prior Publication Data

US 2024/0060391 A1 Feb. 22, 2024

(51) Int. Cl.
*E21B 34/06* (2006.01)

(52) U.S. Cl.
CPC ..... *E21B 34/063* (2013.01); *E21B 2200/08* (2020.05)

(58) Field of Classification Search
CPC ..... E21B 34/063; E21B 2200/08
See application file for complete search history.

(56) References Cited

U.S. PATENT DOCUMENTS 4,603,741 A * 8/1986 Edgmon ..... E21B 34/14 166/373
4,850,432 A * 7/1989 Porter ..... E21B 33/16 166/166
6,286,594 B1 * 9/2001 French ..... E21B 34/063 166/334.4
6,293,342 B1 * 9/2001 McGarian ..... E21B 21/10 166/317
7,726,406 B2 6/2010 Xu
9,441,440 B2 * 9/2016 Hofman ..... E21B 23/00
9,670,750 B2 * 6/2017 Chauffe ..... E21B 34/14
9,976,381 B2 5/2018 Martin et al.
10,138,725 B2 * 11/2018 George ..... E21B 43/116
10,150,713 B2 12/2018 Doud et al.
10,156,119 B2 12/2018 Martin et al.
10,337,279 B2 7/2019 Frazier
10,352,125 B2 7/2019 Frazier
10,641,061 B2 * 5/2020 Bowersock ..... E21B 34/142
10,787,884 B2 * 9/2020 Brandsdal ..... E21B 34/063
11,149,521 B2 * 10/2021 Kennedy ..... E21B 29/02
11,156,050 B1 10/2021 Todd et al.
11,346,178 B2 5/2022 Takahashi et al.
(Continued)

*Primary Examiner* — Steven A MacDonald
(74) *Attorney, Agent, or Firm* — Jackson Walker LLP; Christopher J. Rourk

(57) ABSTRACT

A casing valve is disclosed that includes a first component configured to connect to a casing string, a second component configured to connect to the casing string, a mandrel disposed between the first component and the second component, the mandrel having a plurality of ports, a housing disposed outside of the mandrel, the housing having a plurality of ports, a piston disposed between the mandrel and the housing and configured to move in a first direction from a first position that forms a barrier between the ports of the mandrel and the ports of the housing to a second position that is adjacent to the ports of the mandrel and the ports of the housing and a dissolvable component configured to restrain the piston in the first position and to dissolve when exposed to a fluid to release the piston.

20 Claims, 3 Drawing Sheets

(56) References Cited

U.S. PATENT DOCUMENTS

2002/0166665 A1* 11/2002 Vincent ..... E21B 33/14 166/291
2006/0169464 A1* 8/2006 Richards ..... E21B 43/045 166/332.8
2007/0125532 A1* 6/2007 Murray ..... E21B 33/1216 166/179
2008/0066923 A1* 3/2008 Xu ..... E21B 23/00 166/376
2012/0279723 A1* 11/2012 Hofman ..... E21B 34/063 166/373
2013/0341034 A1* 12/2013 Biddick ..... F16K 31/06 166/373
2014/0076578 A1* 3/2014 Hofman ..... E21B 34/10 166/373
2014/0116721 A1* 5/2014 Hofman ..... E21B 23/00 166/373
2014/0251636 A1* 9/2014 Hofman ..... E21B 34/103 166/373
2015/0041133 A1* 2/2015 Chauffe ..... E21B 34/063 166/284
2015/0129205 A1* 5/2015 Hofman ..... E21B 34/103 166/250.01
2015/0354310 A1 12/2015 Zaiser
2015/0369007 A1* 12/2015 George ..... E21B 34/063 166/305.1
2015/0369008 A1* 12/2015 Shaffer ..... E21B 43/116 166/305.1
2015/0369009 A1* 12/2015 George ..... E21B 34/108 166/374
2015/0369011 A1* 12/2015 Hardesty ..... E21B 34/108 166/305.1
2015/0369040 A1* 12/2015 George ..... E21B 47/117 166/250.08
2016/0237781 A1* 8/2016 Bacsik ..... E21B 34/10
2017/0275967 A1* 9/2017 Sargent ..... E21B 34/14
2018/0283130 A1* 10/2018 Hofman ..... E21B 34/063
2019/0078414 A1 3/2019 Frazier
2020/0149366 A1 5/2020 Kellner
2020/0157916 A1* 5/2020 Hofman ..... E21B 34/103
2020/0406496 A1 12/2020 Howard et al.
2021/0230971 A1 7/2021 Saraya et al.
2021/0253773 A1 8/2021 Ren et al.

* cited by examiner

300

DELAYED OPENING FLUID COMMUNICATION VALVE

TECHNICAL FIELD

The present disclosure relates generally to downhole equipment, and more specifically to downhole equipment with dissolving components.

BACKGROUND OF THE INVENTION

Downhole equipment must be rugged enough to survive a harsh environment, which generally prevents dissolving components from being used.

SUMMARY OF THE INVENTION

A casing valve is disclosed that includes a first component configured to connect to a casing string, a second component configured to connect to the casing string, a mandrel disposed between the first component and the second component, the mandrel having a plurality of ports, a housing disposed outside of the mandrel, the housing having a plurality of ports, a piston disposed between the mandrel and the housing and configured to move in a first direction from a first position that forms a barrier between the ports of the mandrel and the ports of the housing to a second position that is adjacent to the ports of the mandrel and the ports of the housing and a dissolvable component configured to restrain the piston in the first position and to dissolve when exposed to a fluid to release the piston.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings may be to scale, but emphasis is placed upon clearly illustrating the principles of the present disclosure. Moreover, in the drawings, like reference numerals designate corresponding parts throughout the several views, and in which.

DETAILED DESCRIPTION OF THE INVENTION

Figure 1:
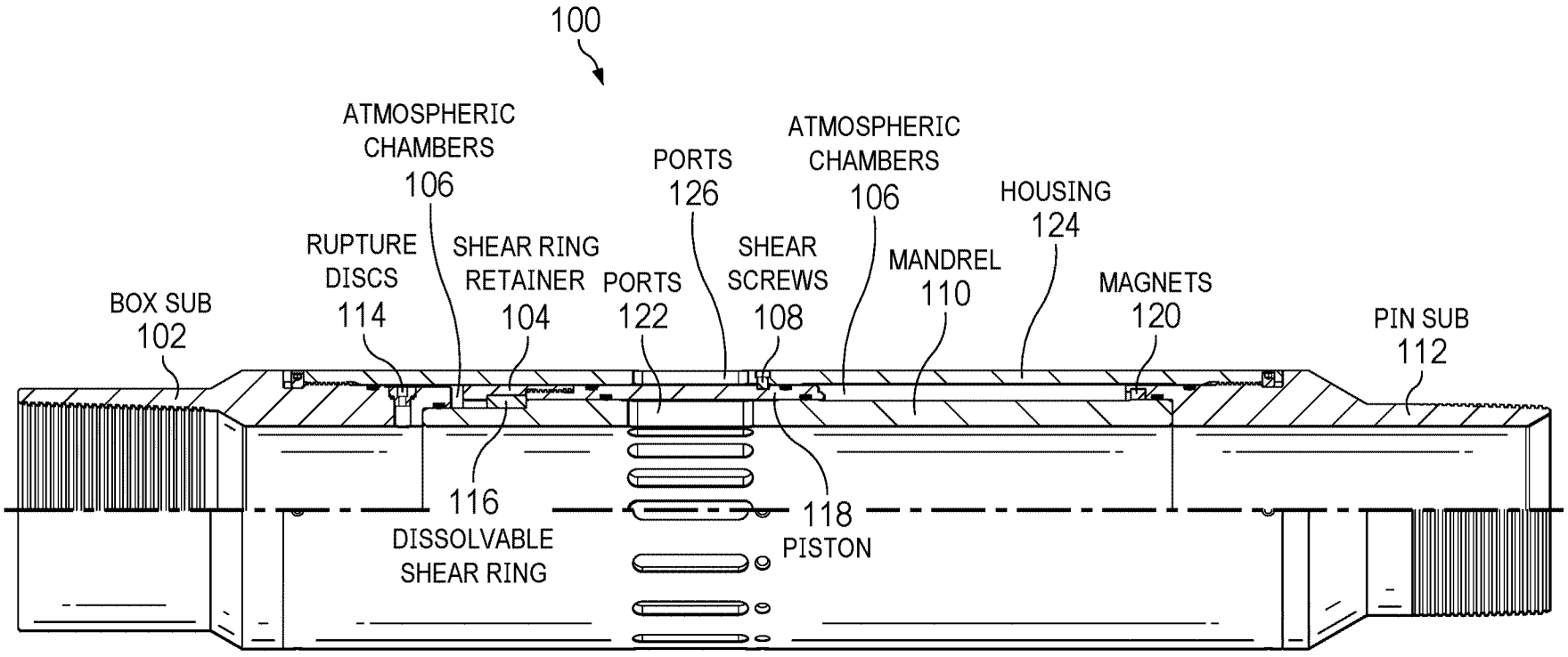
FIG. 1 is a diagram of a valve with dissolving components, in accordance with an example embodiment of the present disclosure.

In the description that follows, like parts are marked throughout the specification and drawings with the same reference numerals. The drawing figures may be to scale and certain components can be shown in generalized or schematic form and identified by commercial designations in the interest of clarity and conciseness.

Regulations on oil and gas wells in some states require a mechanical integrity test of the casing prior to high pressure stimulation. The previous generation of toe initiation valves open as soon as a pre-determined pressure is achieved, resulting in immediate communication between the inside of the casing and the annulus, and thus don't allow for high pressure to be applied to the casing for an extended amount of time (casing test).

The present disclosure allows for the valve to be initiated upon application of high pressure (at the beginning of the casing test) but not opened, and therefore preventing communication from being established between the casing and annulus, until a pre-determined amount of time has passed.

FIG. 1 is a diagram of a valve 100 with dissolving components, in accordance with an example embodiment of the present disclosure. Valve 100 can be used with a toe initiation valve or other suitable valves, such to re-establish communication with the formation once a casing string has been installed or for other suitable purposes. In one example embodiment, valve 100 can be used to delay the communication with the formation as soon as a rupture disc or other suitable pressure-controlled devices are actuated, by preventing a piston or other suitable components from shifting with the valve.

Valve 100 includes box sub 102, shear ring retainer 104, atmospheric chambers 106, shear screws 108, mandrel 110, pin sub 112, rupture discs 114, dissolvable shear ring 116, piston 118, magnets 120, ports 122 and 126 and housing 124, which are assembled and shipped in the configuration shown for deployment in a downhole run of drilling tubulars. Box sub 102 is configured to be connected to an up-hole portion of a string of casing tubulars (not explicitly shown) or other suitable components. Box sub 102 can be fabricated from steel, carbon steel or other suitable materials.

Shear ring retainer 104 can be formed from steel, carbon steel or other suitable materials, and is configured to interface with piston 118 to hold dissolvable shear ring 116 in position. In one example embodiment, shear ring retainer 104 can be replaced with set screws, pins or other suitable devices.

Atmospheric chambers 106 can be features that are machined into or otherwise formed from box sub 102, mandrel 110, shear ring retainer 104, housing 124 and other components, and are configured to create an area having an atmospheric pressure, to allow rupture discs 114 to rupture at a predetermined pressure or for other suitable purposes. Atmospheric chambers 106 can have other suitable locations or configurations.

Shear screws 108 can be formed from steel having an engineered shear strength to allow shear screws 108 to shear at a predetermined level of mechanical stress. In one example embodiment, the shear strength of shear screws 108 can be calculated and used to determine a number and placement of shear screws 108. Likewise, while shear screws 108 are shown, a shear pin, a shear ring or other suitable shear devices can also or alternatively be used.

Mandrel 110 can be formed from steel, carbon steel or other suitable components and can be configured to move within a predetermined area within a space defined by box sub 102, pin sub 112 and other components of valve 100. Mandrel 110 can include a plurality of ports 122, which are discussed further herein.

Pin sub 112 is configured to be connected to a down-hole portion of a string of casing tubulars (not explicitly shown)

or other suitable components. Pin sub 112 can be fabricated from steel, carbon steel or other suitable materials.

Rupture discs 114 can be formed from aluminum, steel, nickel or other suitable materials having an engineered rupture strength to allow rupture discs 114 to shear at a predetermined level of mechanical stress. In one example embodiment, the rupture strength of rupture discs 114 can be calculated and used to determine a number and placement of rupture discs 114. Likewise, while rupture discs 114 are shown, a pressure safety disc, burst disc, bursting disc, burst diaphragm or other suitable devices can also or alternatively be used.

Dissolvable shear ring 116 can be formed from a dissolvable ceramic material, a coated dissolvable ceramic material, or other suitable dissolvable materials. In one example embodiment, dissolvable shear ring 116 can be formed from materials disclosed in U.S. Pat. Nos. 7,726,406, 11,346,178, 10,150,713 or other suitable dissolvable materials or combinations of materials.

Piston 118 can be formed from steel or other suitable materials and can be configured to move between mandrel 110, box sub 102 and pin sub 112. Piston 118 is configured to selectively block ports 122 of mandrel 110 from fluid communication with ports 126 of housing 124 in a first position and to allow fluid communication between ports 122 of mandrel 110 and ports 126 of housing 124 by moving to a position adjacent to those ports, which allows fluids to be delivered to the formation outside of the casing at valve 100 or for other suitable purposes.

Magnets 120 can be fabricated from nickel, cobalt, iron, neodymium, dysprosium or other suitable materials, and are configured to hold piston 118 in an open position. In one example embodiment, magnets 120 can be located in additional locations or other suitable locations.

Housing 124 can be formed from steel or other suitable materials and can be configured to include ports 120. In one example embodiment, ports 126 of housing 124 can be blocked from fluid communication with ports 122 of mandrel 110 by piston 118 until shear screws 108 and dissolvable shear ring 116 have lost mechanical integrity and allow piston 118 to be moved to an open position to allow fluid communication between ports 126 and ports 122 of mandrel 110, or in other suitable configurations.

In operation, valve 100 is deployed in a casing string, where hydrostatic and applied surface pressure can act on rupture discs 114. Atmospheric pressure trapped inside of atmospheric chambers 106 causes rupture discs 114 to rupture at a predetermined pressure. Pressure is then applied to the piston area created by piston 118 between housing 124 and mandrel 110. In one example embodiment, at a predetermined pressure such as 20,000 psi or other suitable pressures, (such as a maximum rupture disc rating offered), approximately 145 klbs of force will be applied to piston 118. Shear screws 108 can include 16 separate screws that are configured to shear at 2,000 lbs each, for a total of 32,000 lbs of shear strength, and in conjunction with dissolvable shear ring 116, can be configured to prevent piston 118 from shifting until predetermined conditions are met.

In this example embodiment, dissolvable shear ring 116 can be configured to withstand ~118 klbs when 20,000 psi is applied, or other suitable withstand criteria can also or alternatively be used. Shear screws 108 are reliable but can have a +/−15% tolerance. An example of mechanical properties for dissolvable material is as follows: density of 1.8 g/cm$^3$, tensile strength of 54 MPa, compressive strength of 1.14 GPA and an abraded modulus of rupture of 52.4 MPs.

In this example, a required thickness can be determined from the following equations:

$$\text{Thickness}=\text{Load}/(\pi*\text{ShearPlaneØ}*\text{UltimateShearStrength})$$

$$\text{Thickness}=118{,}000\ \text{lbs}/(\pi*5.747\ \text{in}*7{,}832\ \text{lb}/(\text{in}^2))$$

$$\text{Thickness}=0.834\ \text{in.}$$

Based on the example mechanical properties of dissolvable shear ring 116, a minimum thickness of 0.834" is required in conjunction with the 16 shear screws 108 to prevent piston 118 from shifting.

Dissolvable shear ring 116 is configured as shown to be in contact with fluid, which causes its mechanical properties to decrease during the dissolution process. Once dissolvable shear ring 116 has been exposed to fluid for a predetermined period of time, it shears, along with shear screws 108, which allows piston 118 to shift downward, completely exposing the ports 122 in mandrel 110 and providing a communication path to the external rock formation. Piston 118 can be held open by magnets 120 installed in pin sub 112, or in other suitable manners.

Figure 2:
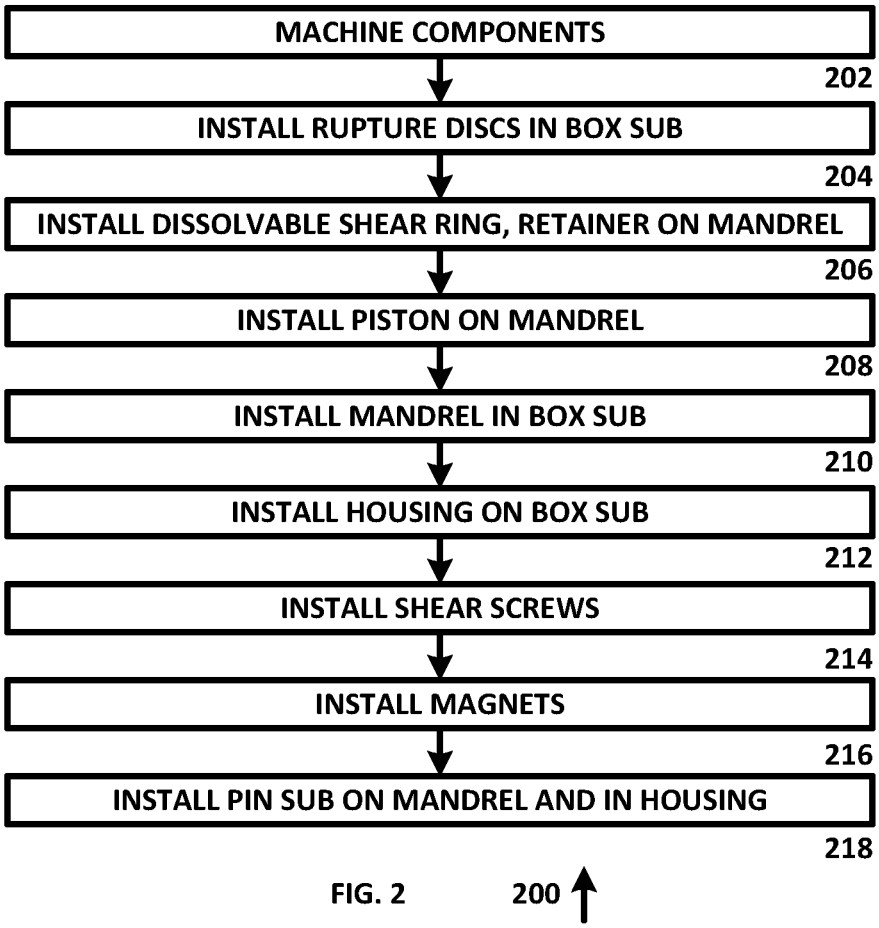
FIG. 2 is a diagram of an algorithm for controlling a manufacturing process for a valve with dissolving components, in accordance with an example embodiment of the present disclosure.

FIG. 2 is a diagram of an algorithm 200 for controlling a manufacturing process for a valve with dissolving components, in accordance with an example embodiment of the present disclosure. Algorithm 200 can be implemented in hardware or a suitable combination of hardware and software.

Algorithm 200 begins at 202, where components for the valve are machined. In one example embodiment, the machined components can include a structure for holding a dissolvable shear ring that works in conjunction with shear screws or other components that dissolve to improve the reliability of a shear component. The structure can be configured to expose the dissolvable shear ring or other suitable dissolvable components to a fluid at a predetermined time, such as after the valve has been placed in a predetermined location. The algorithm then proceeds to 204, such as after a workflow controller generates a notification that all components have been completed.

At 204, rupture discs are installed on a box sub. In one example embodiment, the rupture discs and box sub can be configured to interlock or can be configured in other suitable configurations. The algorithm then proceeds to 206, such as after automated testing, after an operator confirms in a workflow controller that the rupture discs have been installed, or in conjunction with other suitable automated processes.

At 206, a dissolvable shear ring and shear ring retainer are installed on a mandrel. In one example embodiment, the dissolvable shear ring, shear ring retainer and mandrel can be configured to interlock or can be configured in other suitable configurations. The algorithm then proceeds to 208, such as after automated testing, after an operator confirms in a workflow controller that the dissolvable shear ring and shear ring retainer are installed on the mandrel, or in conjunction with other suitable automated processes.

At 208, the piston is installed on the mandrel. In one example embodiment, the piston and mandrel can be configured to interlock or can be configured in other suitable configurations. The algorithm then proceeds to 210, such as after automated testing, after an operator confirms in a workflow controller that the piston has been installed on the mandrel, or after other suitable automated processes.

At 210, the mandrel is installed in the box sub. In one example embodiment, the mandrel and box sub can be configured to interlock or can be configured in other suitable configurations. The algorithm then proceeds to 212, such as after automated testing, after an operator confirms in a workflow controller that the mandrel has been installed on the box sub, or after other suitable automated processes.

At 212, a housing is installed on the box sub. In one example embodiment, the housing and box sub can be configured to interlock or can be configured in other suitable configurations. The algorithm then proceeds to 214, such as after automated testing, after an operator confirms in a workflow controller that the housing has been installed on the box sub, or after other suitable automated processes.

At 214, shear screws are installed. In one example embodiment, the shear screws can be configured to shear at a predetermined applied force in other suitable configurations. The algorithm then proceeds to 216, such as after automated testing, after an operator confirms in a workflow controller that the shear screws have been installed, or after other suitable automated processes.

At 216, magnets are installed. In one example embodiment, the magnets can be configured to hold the piston or for other suitable purposes. The algorithm then proceeds to 218, such as after automated testing, after an operator confirms in a workflow controller that the magnets have been installed, or after other suitable automated processes.

At 218, the pin sub is installed on the mandrel and housing. In one example embodiment, the pin sub, mandrel and housing can be configured to interlock or can be configured in other suitable configurations. The algorithm then terminates, such as after automated testing, after an operator confirms in a workflow controller that the pin sub has been installed on the mandrel and housing, or after other suitable automated processes.

In operation, algorithm 200 can be used to control a manufacturing process for a valve with dissolving components. Although algorithm 200 is shown as a flow chart, a person of skill in the art will recognize that it can also or alternatively be implemented as a state diagram, a ladder diagram, using object-oriented programming or other suitable programming paradigms.

Figure 3:
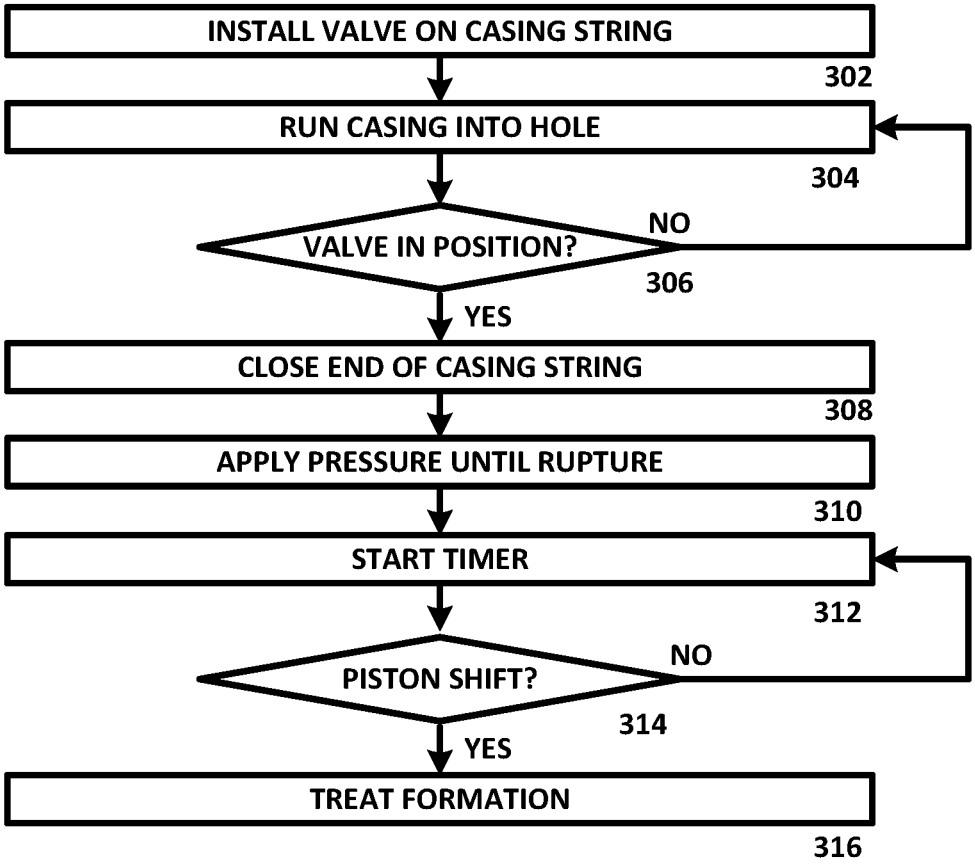
FIG. 3 is a diagram of an algorithm for using a valve with dissolving components, in accordance with an example embodiment of the present disclosure.

FIG. 3 is a diagram of an algorithm 300 for using a valve with dissolving components, in accordance with an example embodiment of the present disclosure. Algorithm 300 can be implemented in hardware or a suitable combination of hardware and software.

Algorithm 300 begins at 302, where a valve with a dissolvable shear ring is installed on a casing string. The run of the casing will need to be modified compared to runs that use a conventional valve when a valve with a dissolvable shear ring is used, such as by adding suitable controls to workflow software. The algorithm then proceeds to 304.

At 304, the casing string with the valve having the dissolvable shear ring is run the into hole. In one example embodiment, the location of the valve with the dissolvable shear ring can be tracked, so as to locate the valve at a predetermined position in the formation that has been drilled, such as by adding suitable controls to workflow software. The algorithm then proceeds to 306.

At 306, it is determined whether the valve is in position. If it is determined that the valve is not in position, the algorithm returns to 304, otherwise the algorithm proceeds to 308.

At 308, the end of the casing string is closed. In one example embodiment, a conventional process can be used to close the end of the casing string, or other suitable processes can also or alternatively be used. The closed casing string allows pressure to be applied to the valve, as well as to initiate the beginning of a casing test. The algorithm then proceeds to 310, such as by adding or activating suitable controls to workflow software.

At 310, pressure is applied until rupture of the rupture disc occurs. In one example embodiment, a timer or other suitable devices can be used to keep track of the time that the dissolvable shear ring has been exposed to a fluid, or other suitable processes can also or alternatively be used. The algorithm then proceeds to 312.

At 312, a timer is started. The timer is used to determine when the dissolvable components should have completed dissolution. The algorithm then proceeds to 314.

At 314, it is determined whether a piston has shifted, such as to open ports on a valve to allow a formation to be treated. If it is determined that the piston has not shifted, the algorithm returns to 312 and the timer continues to run. Otherwise, the algorithm proceeds to 316.

At 316, the formation is treated, such as by pumping salt water or other suitable fluids through the casing to the ports in the valve, where the fluids can enter the formation.

In operation, algorithm 300 can be used to deploy a valve with dissolving components. Although algorithm 200 is shown as a flow chart, a person of skill in the art will recognize that it can also or alternatively be implemented as a state diagram, a ladder diagram, using object-oriented programming or other suitable programming paradigms.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes one or more microcomputers or other suitable data processing units, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections. The term "data" can refer to a suitable structure for using, conveying or storing data, such as a data field, a data buffer, a data message having the data value and sender/receiver address data, a control message having the data value and one or more operators that cause the receiving system or component to perform a function using the data, or other suitable hardware or software components for the electronic processing of data.

In general, a software system is a system that operates on a processor to perform predetermined functions in response to predetermined data fields. A software system is typically created as an algorithmic source code by a human programmer, and the source code algorithm is then compiled into a machine language algorithm with the source code algorithm functions, and linked to the specific input/output devices, dynamic link libraries and other specific hardware and software components of a processor, which converts the processor from a general purpose processor into a specific purpose processor. This well-known process for implementing an algorithm using a processor should require no explanation for one of even rudimentary skill in the art. For example, a system can be defined by the function it performs and the data fields that it performs the function on. As used herein, a NAME system, where NAME is typically the name of the general function that is performed by the system, refers to a software system that is configured to operate on a processor and to perform the disclosed function on the disclosed data fields. A system can receive one or more data inputs, such as data fields, user-entered data, control data in response to a user prompt or other suitable data, and can determine an action to take based on an algorithm, such as to proceed to a next algorithmic step if data is received, to repeat a prompt if data is not received, to perform a mathematical operation on two data fields, to sort or display data fields or to perform other suitable well-known algorithmic functions. Unless a specific algorithm is disclosed, then any suitable algorithm that would be known to one of skill in the art for performing the function using the associated data fields is contemplated as falling within the scope of the disclosure. For example, a message system that generates a message that includes a sender address field, a recipient address field and a message field would encompass software operating on a processor that can obtain the sender address field, recipient address field and message field from a suitable system or device of the processor, such as a buffer device or buffer system, can assemble the sender address field, recipient address field and message field into a suitable electronic message format (such as an electronic mail message, a TCP/IP message or any other suitable message format that has a sender address field, a recipient address field and message field), and can transmit the electronic message using electronic messaging systems and devices of the processor over a communications medium, such as a network. One of ordinary skill in the art would be able to provide the specific coding for a specific application based on the foregoing disclosure, which is intended to set forth exemplary embodiments of the present disclosure, and not to provide a tutorial for someone having less than ordinary skill in the art, such as someone who is unfamiliar with programming or processors in a suitable programming language. A specific algorithm for performing a function can be provided in a flow chart form or in other suitable formats, where the data fields and associated functions can be set forth in an exemplary order of operations, where the order can be rearranged as suitable and is not intended to be limiting unless explicitly stated to be limiting.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A casing valve, comprising:

a first component configured to connect to a casing string;

a second component configured to connect to the casing string;

a mandrel disposed between the first component and the second component, the mandrel having a plurality of ports;

a housing disposed outside of the mandrel, the housing having a plurality of ports;

a piston disposed between the mandrel and the housing and configured to move in a first direction from a first position that forms a barrier between the ports of the mandrel and the ports of the housing to a second position that is adjacent to the ports of the mandrel and the ports of the housing;

a dissolvable component configured to restrain the piston in the first position and to dissolve when exposed to a fluid to release the piston; and a retainer configured to hold the dissolvable component in a first position.

2. The casing valve of claim 1 wherein the dissolvable component comprises a dissolvable shear ring.

3. The casing valve of claim 2 further comprising a shear ring retainer configured to hold the shear ring in a first position.

4. The casing valve of claim 1 further comprising a plurality of shear screws configured to hold the piston in position until a shear force is applied.

5. The casing valve of claim 1 wherein the casing valve is a toe initiation valve.

6. The casing valve of claim 1 further comprising one or more magnets configured to hold the piston in an open position.

7. The casing valve of claim 1 further comprising an atmospheric chamber disposed adjacent to the dissolvable component.

8. The casing valve of claim 7 further comprising a rupture disc disposed adjacent to the atmospheric chamber.

9. A method of manufacturing a well bore tool, comprising:

forming a first component configured to connect to a casing string;

forming a second component configured to connect to the casing string;

forming a mandrel to be disposed between the first component and the second component, the mandrel having a plurality of ports;

forming a housing to be disposed outside of the mandrel, the housing having a plurality of ports;

forming a piston to be disposed between the mandrel and the housing and configured to move in a first direction from a first position that forms a barrier between the ports of the mandrel and the ports of the housing to a second position that is adjacent to the ports of the mandrel and the ports of the housing;

forming a dissolvable component configured to restrain the piston in the first position and to dissolve when exposed to a fluid to release the piston; and forming a retainer configured to hold the dissolvable component in a first position.

10. The method of claim 9 wherein forming the dissolvable component comprises forming a dissolvable shear ring.

11. The method of claim 9 further comprising installing a plurality of shear screws configured to hold the piston in position until a shear force is applied.

12. The method of claim 9 further comprising installing one or more magnets configured to hold the piston in an open position.

13. The method of claim 9 further comprising a forming shear ring retainer configured to hold the shear ring in a first position.

14. The method of claim 9 further comprising forming an atmospheric chamber disposed adjacent to the dissolvable component.

15. The method of claim 9 further comprising forming a rupture disc disposed adjacent to the atmospheric chamber.

16. A casing valve, comprising:

a first component configured to connect to a casing string;

a second component configured to connect to the casing string;

a mandrel disposed between the first component and the second component, the mandrel having a plurality of ports;

a housing disposed outside of the mandrel, the housing having a plurality of ports;

a piston disposed between the mandrel and the housing and configured to move in a first direction from a first position that forms a barrier between the ports of the mandrel and the ports of the housing to a second position that is adjacent to the ports of the mandrel and the ports of the housing; and a dissolvable component configured to restrain the piston in the first position and to dissolve when exposed to a fluid for a predetermined period of time to release the piston, wherein the dissolvable component comprises a dissolvable ceramic.

17. The casing valve of claim 16 wherein the dissolvable component comprises a dissolvable coated ceramic.

18. The casing valve of claim 16 further comprising a plurality of shear screws configured to hold the piston in position until a shear force is applied.

19. The casing valve of claim 16 wherein the casing valve is a toe initiation valve.

20. The casing valve of claim 16 further comprising one or more magnets configured to hold the piston in an open position.

* * * * *